United States Patent [19]

Hinkens

[11] Patent Number: 4,619,489

[45] Date of Patent: Oct. 28, 1986

[54] ADAPTOR FOR AN ELECTRIC TIMER

[75] Inventor: Harold Hinkens, Manitowoc, Wis.

[73] Assignee: AMF Incorporated, White Plains, N.Y.

[21] Appl. No.: 636,881

[22] Filed: Aug. 2, 1984

[51] Int. Cl.[4] ..... H01R 11/00

[52] U.S. Cl. ..... 339/28; 339/193 VS

[58] Field of Search ..... 339/28, 154 R, 154 A, 339/155 R, 193 VS

[56] References Cited

U.S. PATENT DOCUMENTS 3,187,290 6/1965 Winders ..... 339/28

*Primary Examiner*—Gil Weidenfeld

*Assistant Examiner*—Paula A. Austin

*Attorney, Agent, or Firm*—Willian Brinks Olds Hofer Gilson & Lione

[57] ABSTRACT

An adaptor for the positioning of an electric timer which normally plugs directly into a wall socket and hangs in that position. The adaptor allows the timer to rest on a tabletop for easy access while maintaining the necessary electrical connection. The adaptor receives the plug of the wall timer and conforms to the configuration of the rear surface of the timer so that the two units engage to form a unitary type structure. The adaptor and timer can either lay flat on a table or other horizontal surface or be hung on a wall in an accessible location.

3 Claims, 5 Drawing Figures

ADAPTOR FOR AN ELECTRIC TIMER

This invention relates to an adaptor to be used with an electric timer for controlling the operation of an electrical appliance such as a lamp. This timer is of the type that is normally plugged directly into and hangs from a wall socket. A design of this type timer is shown in U.S. Pat. No. Des.265,553 to Joss et al. In particular, this invention functions to convert a wall mount timer into a tabletop timer.

BACKGROUND OF THE INVENTION

Known in the art are table stands for wristwatches which enable the time piece to serve as nighttable clock when not being worn on the wrist. (See U.S. Pat. No. 4,293,943 to Avery et al.) Also known in the art are tabletop timers which control the operation of an electrical device. These timers are similar to any electrical clock in appearance when standing on a tabletop. (See U.S. Pat. No. 2,824,181 to Gallagher et al.)

The preferred embodiment of Applicant's invention consists of a molded base structure having a female receptacle for receiving the male plug of the typical wall mount type timer. The female receptacle is electrically connected to an electric cord having a plug at the free end for connection with a wall socket. The wall timer is plugged into the female receptacle and rests on the adaptor. The top surface of the adaptor is angled to display the timer for easy reading of and access to the time selection dial. Thus, the invention converts the wall timer from a wall socket mounted unit into an easily accessible tabletop unit and can be interchanged as the user desires. Keyhole slots are also included on the bottom surface of the adaptor so that the adaptor can be hung from suitable hangers on a wall. This allows the timer and adaptor to be hung in a location more accessible than the standard electrical outlet.

BRIEF DESCRIPTION OF THE DRAWINGS

FIG. 5 is not to scale.

DESCRIPTION OF THE PREFERRED EMBODIMENT

Figure 1:
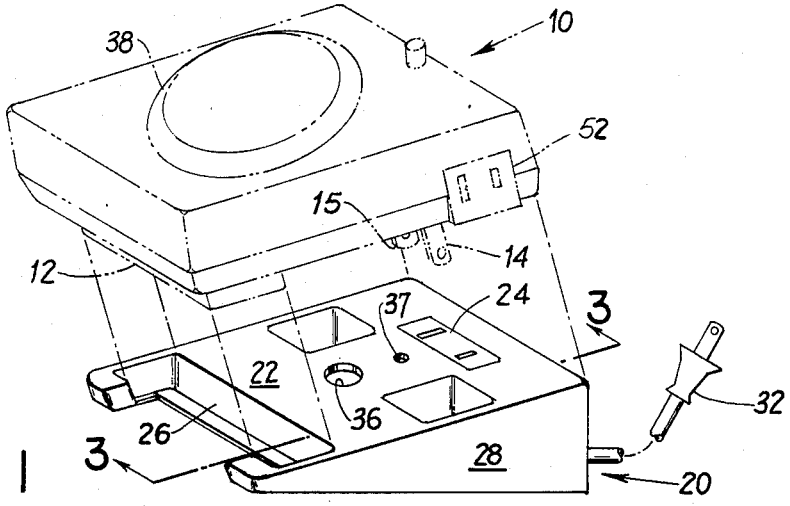
FIG. 1 shows an exploded view of a typical timer and its attachment position with respect to the adaptor of this invention.
Figure 2:
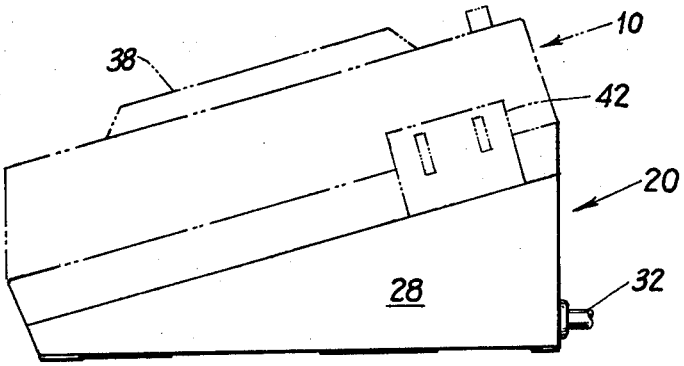
FIG. 2 is a side view of the invention with a timer, in ghost, attached.

Referring to the drawings in greater detail, FIG. 1 shows an exploded view of a typical wall mount timer (10) and an adaptor (20). The typical wall timer has male plug lugs or prongs (14, 15) and a spacing bump (12) on its bottom surface. The male plug lugs (14, 15) normally fit directly into a standard electrical outlet (not shown) found on a wall. The spacing bump (12) keeps the timer assembly parallel to the wall when plugged in and prevents the plug lugs from being exposed by correcting the difference in height between the wall and the switch plate on a standard electrical outlet.

The adaptor (20) is typically formed from a molded material having a supported sloped surface (22) for positioning the timer at an angle (A) (FIG. 3) with respect to the bottom of the adaptor. The typical timer (10) engages the adaptor (20) by plugging the male plug lugs (14, 15) into the female receptacle (24) which is molded into the adaptor (20). This female receptacle is electrically connected to a cord with an end plug (32) for connection to an electrical source. The female receptacle (24) maintains the proper electrical polarity of the timer by accepting the polarized male lug (15) of the timer (10) into the correspondingly polarized slot receptacle (25) and connecting it to the proper lug on the plug (32).

When the male plug (14) is engaging the female receptacle (24), the spacing bump (12) is received by the receiving space (26) at the lower end of the adaptor (20). Thus, the timer (10) lies flush with the sloped surface (22) to create a pleasant appearance and the impression that the two articles are a single unit.

Figure 3:
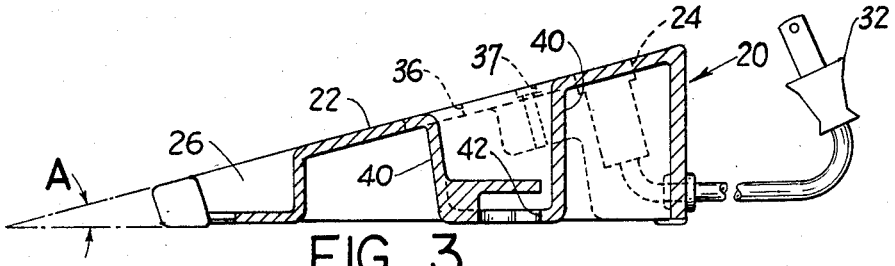
FIG. 3 is a sectional view of the invention taken at line 3—3.
Figure 4:
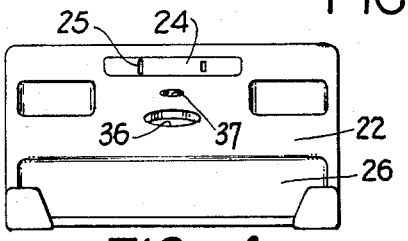
FIG. 4 is a front view of the invention.
Figure 5:
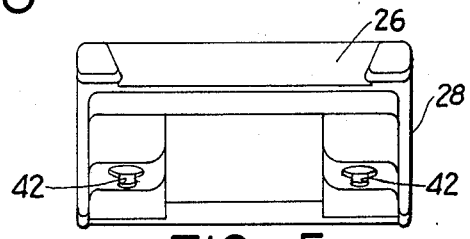
FIG. 5 is a bottom view of the invention taken along a plane parallel to surface 22 of FIG. 3 and rotated so that chamber 26 is at the top showing the keyhole slots.

FIG. 3 shows support ribbing (40) which is hidden from view by the sloped surface (22), by the timer (10) (if attached) and by the side surfaces (28). Also shown in FIG. 3, and again in FIG. 5, are two keyhole slots (42) which may be utilized to hang the adaptor (20) on a wall by means of mounting screws (not shown). This allows the timer to be hung on a wall in a more convenient location than that of the typical wall socket. Once the adaptor is hung by these keyhole slots (42) the timer can easily be removed from the adaptor and any standard plug can be inserted into the female receptacle (24) for connection to the electrical source.

Certain timers provide for removal of the timing dial (38) through the rear of the timer. An opening (36) is provided in the sloped surface (22) for access to the timer's bottom surface from the bottom of the adaptor (10). Also, a mounting hole (37) is provided to permit permanent fixation of the timer (10) to the adaptor (20) by means of an attachment screw (not shown) or similar object.

The adaptor is utilized by plugging the desired electrical appliance to be operated in the timed sequence into the timer (20) at its receiving receptacle (52). The timer is placed into engagement with the adaptor. The entire unit can be set on the tabletop next to the appliance or hung by the keyhole slots. The adaptor's plug (32) electrically connects the timer (10) (and the appliance by way of the timer) to the electric source. The timer dial (38) or other time cycle adjustment means on the timer can be set from this desired location, thus eliminating the necessity of reaching for the electrical outlet. The adaptor permits the timer to optionally be placed so that it is visible at all times or to be removed from the adaptor for use on the wall socket.

Having herein described the invention, what is claimed is:

1. An adaptor for supporting an electric timer which plugs into a polarized wall outlet in a utility position on a table comprising:

(a) a bottom surface and a top surface extending at an angle from one end of the bottom surface;

(b) a polarized electrical receptical on said top surface for receiving the timer plug;

(c) means for electrically connecting said receptacle to an electrical source in a polarized relationship; and (d) means for giving access to the bottom surface of a timer when said timer is plugged into the adaptor.

2. An adaptor according to claim 1 further including slots on the adaptor bottom for mounting said adaptor to hangers affixed to a mounting surface.

3. An adaptor according to claim 1 further including means for receiving a fastening device to secure the timer to the adaptor.

* * * * *